United States Patent [19]

Potter

[11] Patent Number: 4,701,157

[45] Date of Patent: Oct. 20, 1987

[54] LAMINATED ARM COMPOSITE CENTRIFUGE ROTOR

[75] Inventor: Raymond G. Potter, Southbury, Conn.

[73] Assignee: E. I. Du Pont de Nemours and Company, Wilmington, Del.

[21] Appl. No.: 897,813

[22] Filed: Aug. 19, 1986

[51] Int. Cl.[4] ..... B04B 5/02

[52] U.S. Cl. ..... 494/16; 494/81

[58] Field of Search ..... 494/81, 16, 17, 20, 494/21, 85

[56] References Cited

U.S. PATENT DOCUMENTS

| | | | |
|---|---|---|---|
| 2,447,330 | 8/1948 | Grebmeier | 494/16 |
| 3,248,046 | 4/1966 | Feltman | 494/81 |
| 3,361,343 | 1/1968 | Lerner | 494/16 |
| 3,672,241 | 6/1972 | Rabenhorst | 74/572 |
| 3,788,162 | 1/1974 | Rabenhorst et al. | 74/572 |
| 3,884,093 | 5/1975 | Rabenhorst | 74/572 |
| 3,993,243 | 11/1976 | Dietzel | 494/81 |
| 3,997,106 | 12/1976 | Baram | 494/81 |
| 4,000,665 | 1/1977 | Rabenhorst | 74/572 |
| 4,038,885 | 8/1977 | Jonda | 74/581 |
| 4,098,142 | 7/1978 | Weyler, Jr. | 74/572 |
| 4,186,245 | 1/1980 | Gilman | 428/635 |
| 4,207,778 | 6/1980 | Hatch | 74/572 |
| 4,237,175 | 12/1980 | Kobayashi | 428/192 |
| 4,244,240 | 1/1981 | Rabenhorst | 74/572 |
| 4,266,442 | 5/1981 | Zorzi | 74/572 |
| 4,293,276 | 10/1981 | Brogdon et al. | 416/134 |
| 4,321,013 | 3/1982 | Schwarz et al. | 416/244 R |
| 4,386,989 | 6/1983 | Aubry | 156/182 |
| 4,413,860 | 11/1983 | Prescott | 301/63 PW |
| 4,458,400 | 7/1984 | Friedericy et al. | 29/159.3 |
| 4,481,840 | 11/1984 | Friedericy et al. | 74/572 |

*Primary Examiner*—Robert W. Jenkins

[57] ABSTRACT

A centrifuge rotor is formed from an arm having a base portion with enlarged load distributing end regions. The arm and each end region are formed from a plurality of laminae themselves formed of fibers. Each lamina has a direction associated therewith, with the directions of the laminae in each end region defining a predetermined angle with a reference direction defined within the base portion.

40 Claims, 7 Drawing Figures

Fig. 1
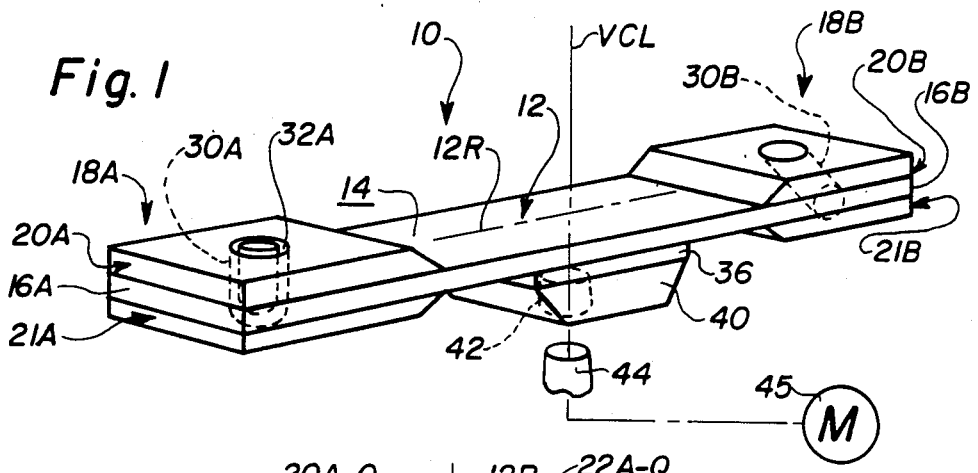
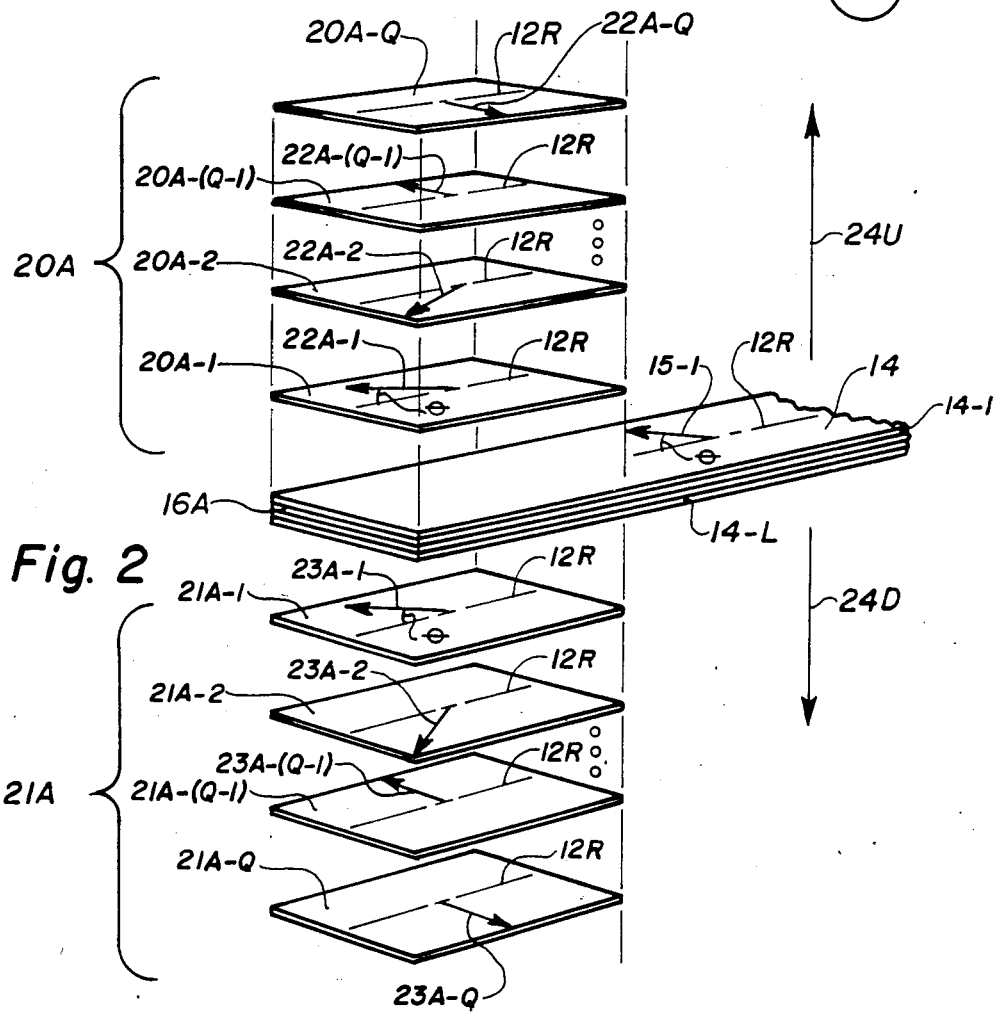
Fig. 2

LAMINATED ARM COMPOSITE CENTRIFUGE ROTOR

BACKGROUND OF THE INVENTION

1. Field of the Invention

The present invention relates to a centrifuge rotor and in particular to a centrifuge rotor fabricated from a plurality of stacked laminated arms.

2. Description of the Prior Art

The trend in the fabrication of rotatable structures has been away from the use of conventional homogeneous materials, such as aluminum or titanium, and toward the use of reinforced fiber composite structures. Such structures are advantageous because they provide an increased strength-to-weight ratio with its attendant advantages over the conventionally fabricated homogeneous structures.

Presently, a typical use of such composite rotatable structures is found in the area of energy storage devices, such as fly wheels. Exemplary of various alternate embodiments of such reinforced fiber composite rotatable structures are those shown in U.S. Pat. No. 4,458,400 (Friedericy et al., composite material flywheel hub formed of stacked fiber-reinforced bars). U.S. Pat. No. 3,672,241 (Rabenhorst, rotary element formed of layered strips of anisotropic filaments bound in a matrix), U.S. Pat. No. 3,698,262 (Rabenhorst, rotary element having a central hub with a multiplicity of anisotropic filaments). U.S. Pat. No. 3,737,694 (Rabenhorst, stacked discs of hub lamina each carrying an array of bent anisotropic fibers). U.S. Pat. No. 3,884,093 (Rabenhorst, fly-wheel fabricated of sector shaped members centrally connected to a hub, the thickness of each element being greater in the center than at the ends), and U.S. Pat. No. 4,028,962 (Nelson, fly-wheel fabricated of anisotropic material in a disc shape with the central portion of the disc being thinner than the edges).

The use of reinforced fiber material has also been found in other rotating structures, such as rotor blades and tooling. Examplary of such uses are those shown in U.S. Pat. Nos. 4,038,885 (Jonda) and 4,255,087 (Wackerle, et al.). U.S. Pat. No. 3,262,231 (Polch) discloses the utilization of strands of high-tensile strength material, such as glass, as internal reinforcement of rotatable articles such as abrasive wheels.

In the area of centrifuge rotors the art discloses attempts to increase the strength-to-weight ratio. For example, U.S. Pat. No. 2,447,330 (Grebmeier) discloses an ultracentrifuge rotor formed of a metal material which is provided with slots which reduce the weight of the rotor. U.S. Pat. No. 3,248,046 (Feltman et al.) discloses a fixed angle centrifuge rotor formed by winding layers of glass material onto a mandrel. U.S. Pat. No. 4,468,269 (Carey) discloses a rotor with a plurality of rings surrounding a bowl-like body portion.

When using reinforced fiber materials it is advantageous to be able to arrange the fibers so that the maximum strength of the fibers is oriented in a direction parallel to the direction in which maximum centrifugal stress is imposed on the fibers. That is, it is advantageous to be able to provide a spatial relationship of fibers that extends radially outwardly from the central axis of rotation. Most beneficially advantageous is to orient the fibers such that each fiber passes as close as possible through the rotational axis of the structure.

The structure disclosed and claimed in copending U.S. patent application Ser. No. 684,937, filed Dec. 21, 1984 in the names of Popper and Cole and assigned to the assignee of the present invention overcomes the perceived disadvantages of the prior art by providing a rotor using a wound rotor arm. A plurality of wound arms are formed into tiers and the tiers are stacked upon each other.

In view of the foregoing, it is also believed advantageous to provide a centrifuge rotor utilizing a laminated structure arm that facilitates both the placement of sample containers onto the rotor and the mounting of the rotor structure onto its drive and that also enhances the distribution of loads carried at the ends of the rotor into and throughout the entire rotor structure.

SUMMARY OF THE INVENTION

The present invention relates to a composite centrifuge rotor formed from one or more elongated laminated arms. The arms may be stacked into tiers and the tiers themselves stacked atop each other.

Each laminated arm is a system comprised of a stacked plurality of laminae. Each lamina is formed of fibers supported in a suitable resinous matrix. Each lamina has a predetermined direction associated therewith. Typically the direction of a lamina is determined in accordance with the direction of the majority of the fibers forming it.

Each arm includes a base portion which is comprised of a plurality of stacked laminae. The longitudinal axis of the base portion defines a predetermined reference direction. The directions of the upper and lower exterior laminae of the base portion may define predetermined angles with respect to the reference direction.

At each end of the base portion an enlarged load distribution region is formed. The load distribution region is formed by symmetrically stacking a plurality of laminae both above and below the base portion. The directions of the laminae define predetermined angles with respect to the reference direction. The laminae in the end regions are stacked such that the directions of the laminae are repeated symmetrically as one proceeds above and below the center plane of the base portion. The lamina in each of the stacked end regions that lies next adjacent to the base portion is arranged with its direction substantially aligned with the direction of the adjacent exterior lamina of the base portion.

Suitable sample carrying means, such as one or more recesses, each oriented either parallel to or inclined with respect to the vertical central axis of rotation of the arm, is provided in each enlarged end region of each arm. The recesses receive a sample container carrying a sample to be centrifuged. The same number of similarly located and similarly oriented recesses are provided at each end of each arm.

The symmetrically stacked laminae forming the enlarged end regions of the arm serve to distribute into the base portion loads imposed on the ends of the arm by the sample, sample container and the mass of the enlarged ends of the arm.

The central region of the base member of the arm is provided with a mounting pad formed of a symmetrically stacked plurality of laminae. In the preferred case the direction of the exterior lamina in the mounting pad is aligned with the direction of the exterior lamina of the base to which the pad is adjacent. A drive fitting is attached to the pad whereby the arm may be connected to the rotor drive.

A predetermined number N of arms may be stacked atop each other to form an N-armed tier, where N is an integer greater than or equal to two. A mounting pad similar to that above discussed is provided below the central portion of the lowermost arm in the tier whereby the tier is connected to a suitable drive. A transition pad is disposed above the lowermost arm, below the uppermost arm, and both above and below any intermediate arms whereby vertically adjacent arms forming the tier may be interconnected. Each transition pad is formed of a symmetrically stacked plurality of laminae similar to the structure of the mounting pad as discussed earlier. The direction of the laminae on the upper and/or lower surface of a transition pad, as the case may be, substantially aligns with the direction of the exterior lamina of the arm to which the surface of the pad is adjacent.

A plurality of tiers of arms may be stacked atop each other with the ends of each arm in each tier being vertically registered. The confronting surfaces of the ends of the vertically registered arms may be attached. One or more recesses may be provided in the vertically registered enlarged ends. A transition pad similar to that disposed between adjacent arms in a tier is disposed between adjacent tiers.

BRIEF DESCRIPTION OF THE DRAWINGS

The invention will be more fully understood from the following detailed description thereof taken in connection with the accompanying drawings which form a part of this application and in which:

FIG. 1 is an isolated perspective view of one laminated arm in accordance with the present invention:

FIG. 2 is an exploded perspective view of one enlarged end region of the laminated arm shown in FIG. 1;

DETAILED DESCRIPTION OF THE INVENTION

Figure 3:
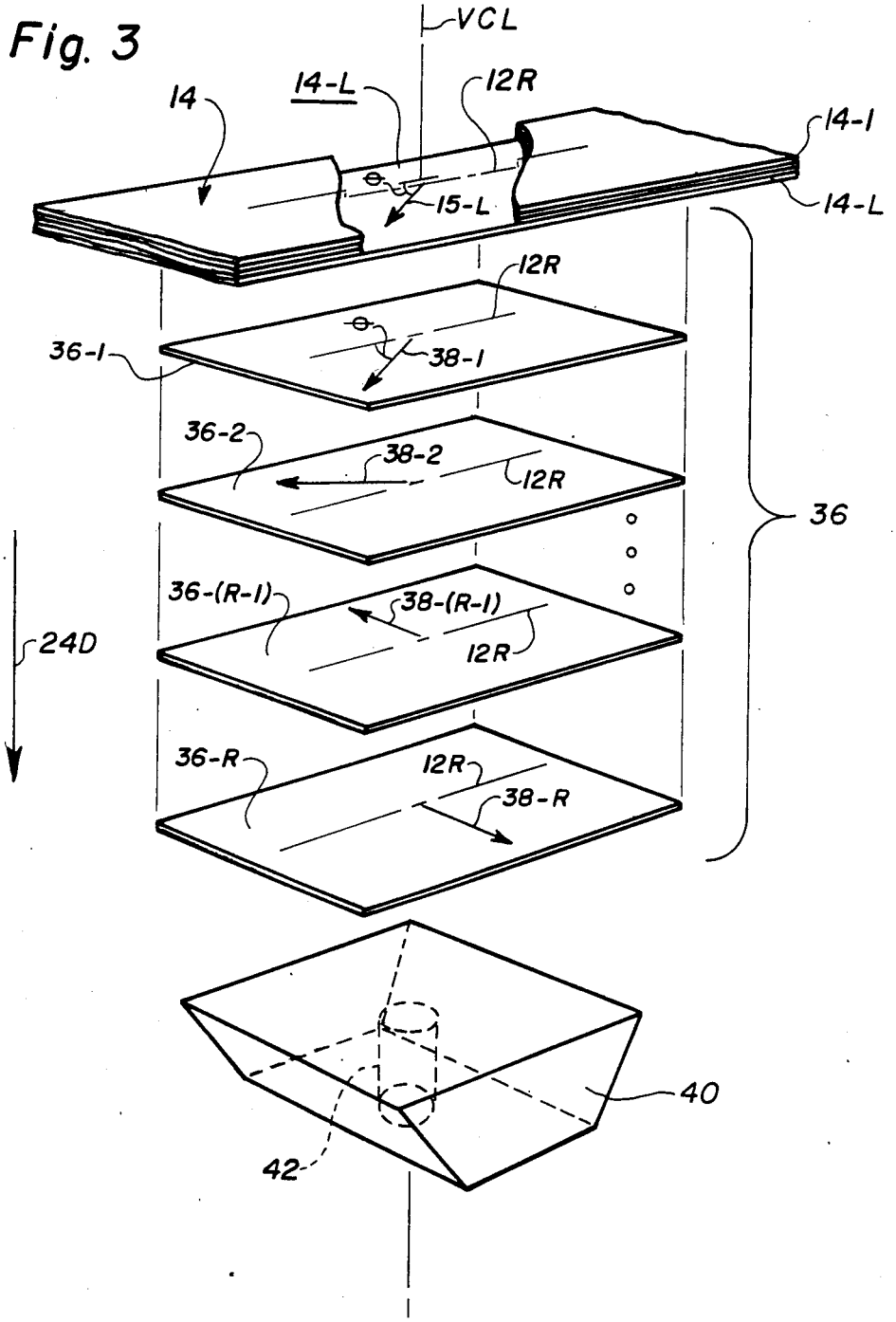
FIG. 3 is an exploded view showing a mounting pad arrangement formed of laminae stacked in the central portion of the arm of FIG. 1.

Throughout the following detailed description similar reference numerals refer to similar elements in all figures of the drawings.

Shown in FIG. 1 is an isolated perspective view of a centrifuge rotor 10 formed of a single arm 12 embodying the teachings of this invention. The arm 12 includes a base portion 14 which is provided with first and second ends 16A and 16B, respectively. The base portion 14 is, in the preferred case, manufactured as a laminate formed from a plurality of laminae 14-1 through 14-L, where L is any predetermined integer. The base portion 14 may have any predetermined vertical thickness, as measured along the axis of rotation VCL, comportion with any predetermined design requirements.

As used in this application the term "lamina" means a system comprised of a sheet-like arrangement of a plurality of unidirectional or woven carbon or aramid fibers coated with a suitable resinous matrix material such as epoxy. Suitable for use as the aramid fiber is that manufactured and sold by E. I. du Pont de Nemours and Company under the trademark Kevlar®. It should, however, be understood that the base portion 14 may be fabricated in any convenient alternate manner, such as pultrusion, and lie within the contemplation of this invention. Such alternatives are to be construed as functional equivalents of a lamina. Each lamina has a predetermined "direction" associated therewith. Although a direction may be arbitrarily assigned to a lamina, in the preferred instance a lamina's direction is defined in accordance with the direction of a majority of the fibers forming the lamina.

The base portion 14 has a central longitudinal axis 12R which defines a reference axis of the arm 12 for purposes which shall become understood from the discussion which follows herein. The reference axis 12R lies in a plane substantially parallel to the plane of the upper and lower laminae 14-1, 14-L, respectively. In the preferred instance the direction of the laminae forming the base portion 14, including the laminae 14-1 and 14-L defining the upper and lower surfaces of the base 14 generally align with the reference axis 12R. However, it should be understood that the directions of the base laminae, including the direction of the laminae forming the exterior surfaces, i.e., the lowermost lamina 14-1 and the uppermost lamina 14-L, may define a predetermined angle with respect to the reference axis 12R. The reference vector 15 is used herein to denote the direction of each lamina forming the base 14. As seen in FIG. 2 the vector 15-1 is shown to indicate that the direction of the lamina 14-1 defines a predetermined reference angle $\theta$ with respect to the reference axis 12R. A similar reference vector and reference angle may be drawn to denote the direction of the other laminae, including the lamina 14-L. Preferably, but not necessarily, the reference directions for the laminae 14-l and 14-L, respectively, are coincident with each other.

At each end 16A and 16B of the base portion 14 vertically enlarged load distributing regions 18A and 18B respectively are formed. In the embodiment illustrated in FIGS. 1 and 2 the enlarged load distributing end regions 18A, 18B are formed by symmetrically stacking a predetermined plurality of laminae (as earlier defined) to form stacks 20 and 21 above and below each end 16A, 16B, respectively, of the base portion 14. In accordance with the present invention the laminae in the enlarged load distributing regions are arranged with respect to the base portion 14 to provide a distribution of the load imposed by a sample, sample container and the mass of the end region itself into the material of the base portion. To accomplish this end the directions of the laminae in the stacks 20 and 21 are oriented in a manner to be discussed at predetermined angles with respect to the reference axis 12R of the base portion 14.

With reference to FIG. 2 shown is an exploded view of enlarged load distributing region 18A disposed at the end 16A of the base member 14. Accordingly, the laminae in the stacks 20 and 21 are identified by a suffix "A" indicating their location at the end 16A of the base portion 14. A similar arrangement is disposed at the opposite end 16B. The stacks 20A, 21A are respectively comprised of a plurality Q (where Q is any predetermined integer) of laminae, as that term is defined above.

In FIG. 2, the directions of the individual lamina 20A-1 through 20A-Q are indicated by the reference vector 22, while the directions of the individual lamina 21A-1 through 21A-Q are indicated by the reference vector 23. In accordance with the most preferred embodiment of the present invention the reference vector 22A-1 (corresponding to the direction of the lamina 20A-1) substantially aligns with the reference vector 15-1 corresponding to the direction of the upper exterior lamina 14-1 of the base portion 14. Preferably the reference vector 22A-1 would totally align with the reference vector 15. That is, the reference vector 22A-1 defines the same predetermined angle $\theta$ as is defined by the reference vector 15-1, both with respect to the reference axis 12R. Similarly the reference vector 23A-1 for the lamina 21A-1 is arranged to substantially align with the reference vector corresponding to the direction of the lowermost exterior lamina 14-1. Again in the preferred instance, the angle between the reference vector 23A-1 and the reference axis 12R is the same as the angle defined between the direction 15-L of the lowermost lamina 14-L and the reference axis 12R. Most preferably, this angle would be the same predetermined angle $\theta$.

The laminae forming the stacks 20, 21 are, as noted earlier, symmetrically arranged with respect to each other as one proceeds in the vertical upward direction 24U and the vertical downward direction 24D. By "symmetrically arranged" it is meant that the laminae are stacked in a sequence such that the laminae have directions that are symmetric about a predetermined symmetry plane, typically the center plane of the base portion 14. In the case of the end regions shown in FIG. 2, with the symmetry plane selected as the center plane of the base portion 14, the directions of the laminae of the stacks 20, 21 disposed at the same vertical distance above and below the symmetry plane, as represented by their respective vectors 22A, 23A, correspond.

Any suitable angular orientation may be effected so long as the directions of the laminae in the enlarged ends 18 serve to distribute load to the base member 14. It should be noted that the base portion 14 may itself be formed so that its laminae 14-1 to 14-L are symmetric about the predetermined symmetry plane.

The enlarged end regions may be formed by techniques other than stacking. For example, it lies within the contemplation of this invention to have the laminae forming the enlarged end region 18 interspersed between the laminae forming the base portion 14. Any other convenient means of fabricating an arm 12 having the attributes of directionality and symmetry discussed above lies within the contemplation of this invention.

Figure 4:
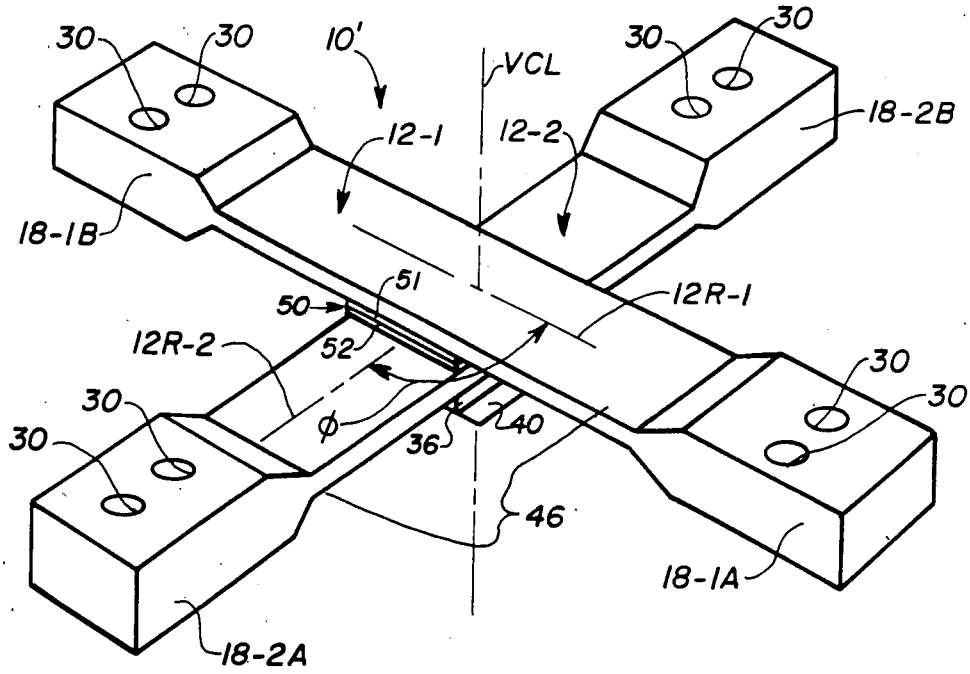
FIG. 4 is a perspective view of the centrifuge rotor fabricated of a plurality of arms such as shown in FIG. 1 stacked atop each other to form a multi-arm tier, each arm in the tier having a transition pad disposed therebetween.

The stacks 20 and 21 of laminae at each end 16A and 16B of the arm 12 define the enlarged end regions 18A, 18B into which sample receiving recesses 30A and 30B may be respectively provided. Other suitable means for carrying a sample may, of course, be used. The recesses may be oriented at either a vertical angle, i.e., parallel with respect to the axis of rotation VCL as shown by the recess 30A, or may be inclined with respect thereto, as with the recess 30B. Whatever orientation is chosen, the recesses 30 at each end of an arm 12 are similarly oriented. It should also be understood that more than one recess 30 may be provided in each enlarged end region 18. For example, as seen in FIG. 4, a plurality of recesses 30 may be circumferentially and/or radially arranged in each enlarged end region 18, (with some being vertically oriented and some inclined, if desired) with the proviso that the same number, arrangement and orientation of recesses 30 is provided in each end of each arm. The recess 30 may extend entirely through the end region 18, if desired. A suitable sample container 32 (FIG. 1) may be removably placed or secured (as by adhesive bonding) in each recess 30, if desired.

Briefly summarizing, hereinabove disclosed is a rotor structure formed of a laminated base portion 14 having enlarged laminated load distribution regions at each end thereof. The directions of the laminae in the load distributing regions are angled with respect to the reference axis of the arm. As a result of the formation of the enlarged end regions 18A, 18B by the stacking of laminae 20A, 20B and 21A, 21B, as hereinabove described, centrifugal loads created by the container and the sample are more uniformly distributed to the base portion 14 than if the enlarged end regions 18 were not present.

The rotor 10 such as shown in FIGS. 1 through 3 (i.e., a rotor 10 formed from a single arm 12) may be mounted to a suitable motor drive M by means of a mounting pad 36 disposed centrally beneath the base portion 14. The mounting pad 36 is comprised of a predetermined plurality of laminae 36-1 through 36-R (FIG. 3), where R is a predetermined integer. The direction of the laminae 36 are indicated by the reference vector 38 and, in accordance with the present invention, the reference vector 38-1 of the lamina 36-1 substantially aligns with the reference vector 15-L (similar to the vector 15-1 in FIG. 1) representing the direction of the lower exterior lamina 14-L. Preferably the direction of the lamina 36-1 defines the same angle $\theta$ with the reference axis 12R as is defined by the reference vector 15-L with the reference axis 12R.

A drive fitting 40 is adhesively or otherwise suitably secured to the lowermost lamina 36-R in the mounting pad 36. By provision of the mounting pad 36 the drive fitting 40 is isolated from the base portion 14 and the tendency of an adhesive bond to fracture when the fitting 40 is adhered directly to the base member 14 is eliminated. The fitting 40 has a recess 42 therein which receives the drive shaft 44 of a suitable drive motor M (Figure 1). The pad 36 may itself be configured to directly receive the shaft 44, if desired.

A centrifuge rotor 10' may be fabricated as a tier 46 comprising a plurality N of the arms 12 where N is an integer equal to or greater than two.

Figure 5:
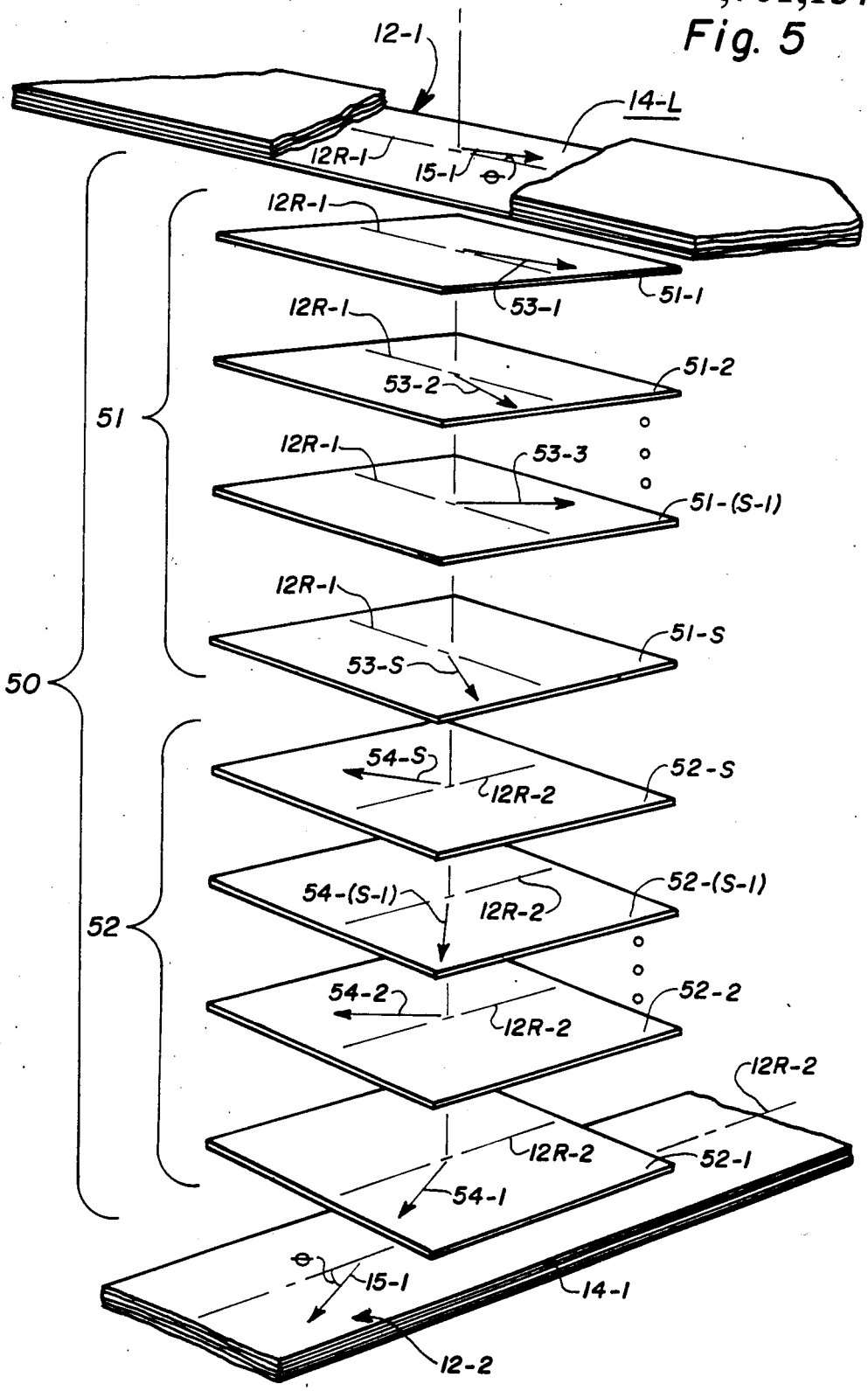
FIG. 5 is an exploded perspective view of a transition pad disposed between the vertically adjacent arms of the rotor of FIG. 4.

In FIG. 4 such a centrifuge rotor 10' is defined by orienting first, upper, arm 12-1 and a second, lower, arm 12-2 with respect to each other such that a predetermined angle $\phi$ is defined between the respective reference axes 12R-1 and 12R-2 of the arms 12-1 and 12-2. Each arm 12-1, 12-2 is formed as discussed in connection with FIGS. 1 through 3. As seen from FIGS. 4 and 5, a transition zone 50 is defined centrally with respect to the vertical center line VCL of the rotor 10' in the interfacing overlapping region between the arms 12-1 and 12-2. To bridge the transition zone 50 the undersurface of the upper arm 12-1 and the upper-surface of the lower arm 12-2 are provided with an upper and a lower transition pad 51, 52, respectively (FIG. 5). Each transition pad 51, 52 is formed of a determined plurality S of stacked laminae (as earlier defined) where S is any predetermined integer.

In the Figures the direction of each lamina 51 is indicated by the reference vector 53, while the direction of the laminae 52 are indicated by the reference vector 54. The reference vector 53-1 of the lamina 51-1 is selected to align substantially with the reference vector 15-L of the lamina 14-L on the lower exterior surface of the arm 12-1. In the preferred case the angle $\theta$ between the vector 53-1 and the reference axis 12R-1 is the same as the angle $\theta$ defined between the vector 15-L and the reference axis 12R-1. In like manner the reference vector 54-1 for the lamina 52-1 aligns substantially (and preferably equiangularly) with the reference vector 15-1 of the upper exterior lamina 14-1 of the arm 12-2.

The use of transition pads above and below adjacent arms as described above may be extended to a tier having more than two arms 12.

Figure 6:
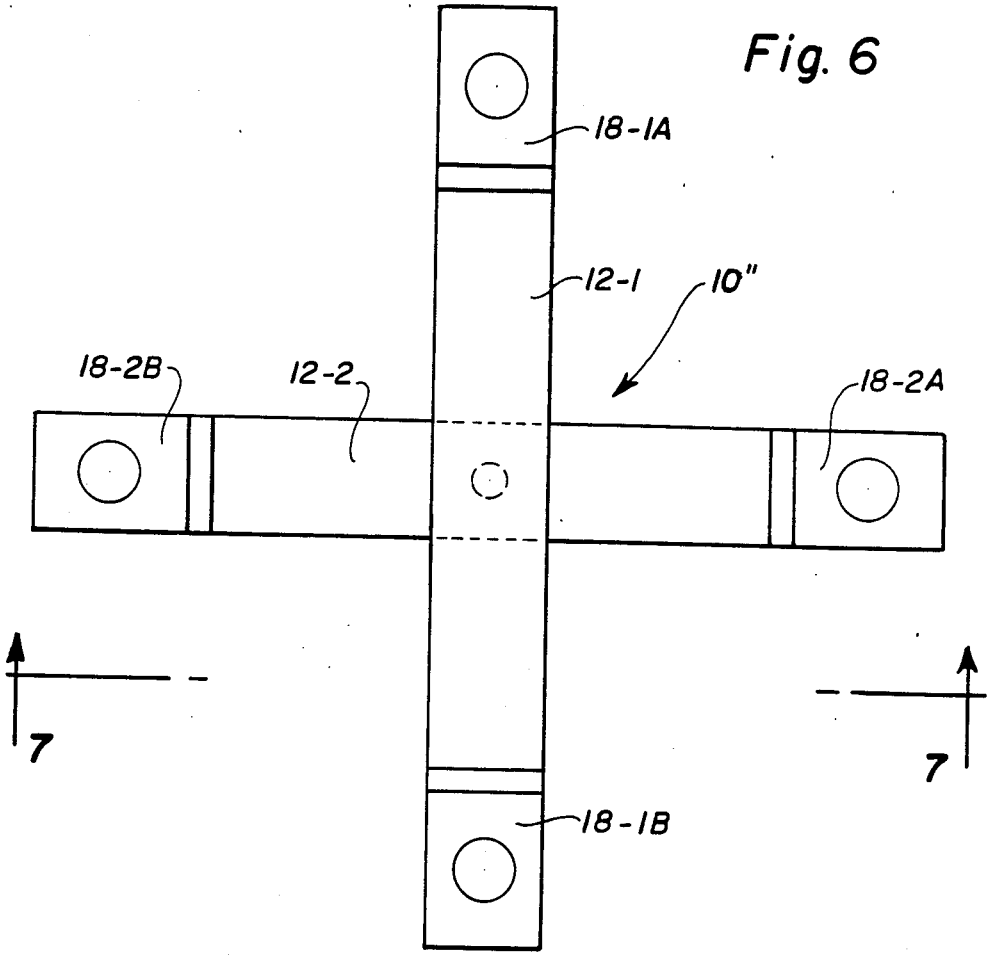
FIG. 6 is a plan view of a multi-tier centrifuge rotor.
Figure 7:
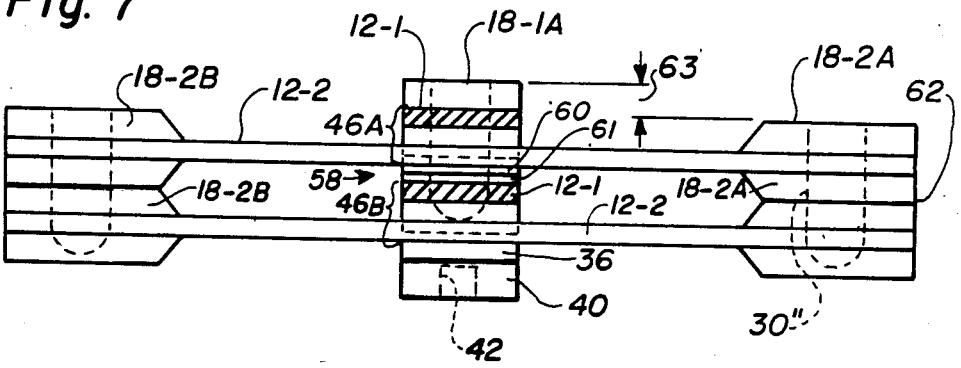
FIG. 7 is a section view of a multi-tier rotor taken along section lines 7—7 in FIG. 6.

A rotor 10'' may be fabricated by stacking a first, upper, tier 46A and a second, lower, tier 46B disposed in vertical registration above each other. As seen in FIGS. 6 and 7 the enlarged ends 18 of each arm 12 in each tier 46A, 46B lie directly above each other. A junction region 58 disposed between the upper arm in the tier 46A and the lower arm in the tier 46B is bridged by respective upper and lower connection pads 60, 61. The connection pads 60, 61 are arranged to bridge the regions 60 in a manner similar to the manner in which the transition pads 51, 52 bridge the region 58 between the adjacent arms of a given tier, as discussed above. The confronting horizontal surfaces of vertically registering ends from adjacent tiers, as at 62, may be secured to each other by epoxy or any suitable adhesive means. The recesses 30'' are defined through the vertically registered enlarged ends as shown in FIG. 7. The upper surfaces of circumferentially adjacent enlarged ends are crenulated, as shown at 63.

Those skilled in the art, having the benefit of the teachings of the present invention as hereinabove set forth, may effect numerous modifications thereto. These and other modifications are to be construed as lying within the scope of the present invention as defined by the appended claims.

What is claimed is:

1. A centrifuge rotor comprising an arm, the arm having a base portion formed from a plurality of laminae each of which is itself formed of fibers in a resin matrix, the base portion having an enlarged load distribution region at each end thereof, each enlarged region being formed from a stack of laminae with each lamina being itself formed of a plurality of fibers in a resin matrix, each enlarged region having means for carrying a sample.

2. The centrifuge rotor of claim 1 wherein the base has a reference axis defined therein and wherein each lamina has a predetermined direction associated therewith, the direction of some of the laminae forming the enlarged load distribution regions defining a predetermined angle with respect to the reference axis.

3. The centrifuge rotor of claim 2 wherein the direction of a lamina forming an exterior surface of an enlarged load distribution region is substantially aligned with the direction of a lamina forming an exterior surface of the base adjacent to that enlarged load distribution region so that loads imposed on the enlarged region may be distributed into the base.

4. The centrifuge rotor of claim 3 wherein the sample carrying means comprises at least one sample receiving recess having an axis formed in the arm, wherein the rotor is rotatable about an axis of rotation, and wherein the axis of each recess is parallel to the axis of rotation.

5. The centrifuge rotor of claim 3 wherein the sample carrying means comprises at least one sample receiving recess having an axis formed in the arm, wherein the rotor is rotatable about an axis of rotation, and wherein the axis of each recess is inclined with respect to the axis of rotation.

6. The centrifuge rotor of claim 3 further comprising a mounting pad disposed below the base portion, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the base, the mounting pad being connectable to a source of motive energy.

7. The centrifuge rotor of claim 2 wherein the sample carrying means comprises at least one sample receiving recess having an axis formed in the arm, wherein the rotor is rotatable about an axis of rotation, and wherein the axis of each recess is parallel to the axis of rotation.

8. The centrifuge rotor of claim 2 wherein the sample carrying means comprises at least one sample receiving recess having an axis formed in the arm, wherein the rotor is rotatable about an axis of rotation, and wherein the axis of each recess is inclined with respect to the axis of rotation.

9. The centrifuge rotor of claim 2 further comprising a mounting pad disposed below the base portion, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the base, the mounting pad being connectable to a source of motive energy.

10. The centrifuge rotor of claim 1 wherein the base has a reference axis defined therein and wherein each lamina has a predetermined direction associated therewith, the direction of a lamina forming an exterior surface of the enlarged load distribution region is substantially aligned with the direction of a lamina forming an exterior surface of the base adjacent to that enlarged load distribution region so that loads imposed on the enlarged region may be distributed into the base.

11. The centrifuge rotor of claim 10 wherein the sample carrying means comprises at least one sample receiving recess having an axis formed in the arm, wherein the rotor is rotatable about an axis of rotation, and wherein the axis of each recess is parallel to the axis of rotation.

12. The centrifuge rotor of claim 10 wherein the sample carrying means comprises at least one sample receiving recess having an axis formed in the arm, wherein the rotor is rotatable about an axis of rotation, and wherein the axis of each recess is inclined with respect to the axis of rotation.

13. The centrifuge rotor of claim 10 further comprising a mounting pad disposed below the base portion, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the base, the mounting pad being connectable to a source of motive energy.

14. The centrifuge rotor of claim 1 wherein the sample carrying means comprises at least one sample receiving recess having an axis formed in the arm, wherein the rotor is rotatable about an axis of rotation, and wherein the axis of each recess is parallel to the axis of rotation.

15. The centrifuge rotor of claim 1 wherein the sample carrying means comprises at least one sample receiving recess having an axis formed in the arm, wherein the rotor is rotatable about an axis of rotation, and wherein the axis of each recess is inclined with respect to the axis of rotation.

16. The centrifuge rotor of claim 1 further comprising a mounting pad disposed below the base portion, the mounting pad being formed from a stacked plurality of laminae each of which is itself formed of fibers in a resin matrix, each lamina in the base and in the mounting pad having a direction associated therewith, the direction of the upper lamina in the mounting pad being substantially aligned with the direction of the lowermost lamina of the base, the mounting pad being connectable to a source of motive energy.

17. A centrifuge rotor comprising:

a tier having a first and a second arm, each arm having a reference axis defined therein, the reference axes being oriented at a predetermined angle with respect to each other, each arm having a base portion formed from a plurality of laminae each of which is itself formed of fibers in a resin matrix, the base portion of each arm having an enlarged load distributing region at each end thereof, each of the enlarged load distribution regions being formed from a stack of laminae with each lamina being itself formed from a plurality of fibers in a resin matrix, each enlarged region having means for carrying a sample; and a lower and an upper transition pad respectively disposed adjacent to the upper surface of the second, lower, arm and the lower surface of the first, upper, arm in the tier, each transition pad being formed from a stacked plurality of lamina, each lamina being itself formed from a plurality of fibers in a resin matrix.

18. The centrifuge rotor of claim 17 wherein each lamina has a predetermined direction associated therewith, the direction of some of the laminae forming the enlarged load distribution regions defining a predetermined angle with respect to the reference axis of the arm with which it is associated.

19. The centrifuge rotor of claim 18 wherein the directions of the uppermost lamina of the upper transition pad and the lowermost lamina of the lower transition pad respectively align with the directions of the lower lamina of the upper arm and the upper lamina of the lower arm.

20. The centrifuge rotor of claim 19 further comprising a mounting pad disposed below the base portion of the lowermost arm in the tier, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the lowermost arm, the mounting pad being connectable to a source of motive energy.

21. The centrifuge rotor of claim 18 wherein the direction of a lamina forming an exterior surface of an enlarged load distribution region is substantially aligned with the direction of a lamina forming an exterior surface of the base adjacent to that enlarged load distribution region so that loads imposed on the enlarged region may be distributed into the base.

22. The centrifuge rotor of claim 21 wherein the directions of the uppermost lamina of the upper transition pad and the lowermost lamina of the lower transition pad respectively align with the directions of the lower lamina of the upper arm and the upper lamina of the lower arm.

23. The centrifuge rotor of claim 18 further comprising a mounting pad disposed below the base portion of the lowermost arm in the tier, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the lowermost arm, the mounting pad being connectable to a source of motive energy.

24. The centrifuge rotor of claim 17 wherein each lamina in each load distribution region has a predetermined direction associated therewith, the direction of a lamina forming an exterior surface of an enlarged load distribution region is substantially aligned with the direction of a lamina forming an exterior surface of the base adjacent to that enlarged load distribution region so that loads imposed on the enlarged region may be distributed into the base.

25. The centrifuge rotor of claim 24 wherein the directions of the uppermost lamina of the upper transition pad and the lowermost lamina of the lower transition pad respectively align with the directions of the lower lamina of the upper arm and the upper lamina of the lower arm.

26. The centrifuge rotor of claim 24 further comprising a mounting pad disposed below the base portion of the lowermost arm in the tier, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the lowermost arm, the mounting pad being connectable to a source of motive energy.

27. The centrifuge rotor of claim 17 further comprising a mounting pad disposed below the base portion of the lowermost arm in the tier, the mounting pad being formed from a stacked plurality of laminae each of which is itself formed of fibers in a resin matrix, each lamina in the mounting pad having a direction associated therewith, the direction of the upper lamina in the mounting pad being substantially aligned with the direction of the lowermost lamina of the lowermost arm, the mounting pad being connectable to a source of motive energy.

28. A centrifuge rotor comprising:

a first and a second tier of arms, each tier comprising a first and a second arm, each arm having a reference axis defined therein, the reference axes being oriented at a predetermined angle with respect to each other with the ends of the arms of the first tier being vertically registered with the ends of the arms of the other tier, each arm having a base portion formed from a plurality of laminae each of which is itself formed of fibers in a resin matrix, the base portion of each arm having an enlarged load distributing region at each end thereof, each of the load distribution regions being formed from a stack of laminae with each lamina being itself formed from a plurality of fibers in a resin matrix, and means for carrying a sample provided on the registered ends of the arms:

a lower and an upper transition pad respectively disposed adjacent to the upper surface of a lower arm in each tier and the lower surface of an adjacent upper arm in each tier, each transition pad being formed from a stacked plurality of lamina, each lamina being itself formed from a plurality of fibers in a resin matrix; and a lower and an upper connection pad respectively disposed adjacent to upper surface of a lower tier and the lower surface of an upper tier, each connection pad being formed from a stacked plurality of lamina, each lamina being formed of a plurality of fibers in a resin matrix.

29. The centrifuge rotor of claim 28 wherein each lamina has a predetermined direction associated therewith, the direction of some of the laminae forming the enlarged load distribution regions defining a predetermined angle with respect to the reference axis of the arm with which it is associated.

30. The centrifuge rotor of claim 29 wherein the direction of the uppermost lamina of the upper transition pad in each tier and the lowermost lamina of the lower transition pad in each tier respectively align with the directions of the lower lamina of the upper arm in the tier and the upper lamina of the lower arm of the tier.

31. The centrifuge rotor of claim 30 wherein the direction of the uppermost lamina of the upper connection pad aligns with the direction of the lowermost lamina of the upper tier and the direction of the lowermost lamina of the lower connection pad aligns with the direction of the uppermost lamina of the lower tier.

32. The centrifuge rotor of claim 31 further comprising a mounting pad disposed below the base portion of the lowermost arm of the lowermost tier, the mounting pad being formed from a stacked plurality of laminae each of which is itself formed of fibers in a resin matrix, each lamina in the base portion of the lowermost arm of the lowermost tier and in the mounting pad having a direction associated therewith, the direction of the uppermost lamina in the mounting pad being substantially aligned with the direction of the lowermost lamina of the base portion of the lowermost arm of the lowermost tier, the mounting pad being connectable to a source of motive energy.

33. The centrifuge rotor of claim 29 wherein the direction of the uppermost lamina of the upper connection pad aligns with the direction of the lowermost lamina of the upper tier and the direction of the lowermost lamina of the lower connection pad aligns with the direction of the uppermost lamina of the lower tier.

34. The centrifuge rotor of claim 33 further comprising a mounting pad disposed below the base portion of the lowermost arm of the lowermost tier, the mounting pad being formed from a stacked plurality of laminae each of which is itself formed of fibers in a resin matrix, each lamina in the base portion of the lowermost arm of the lowermost tier and in the mounting pad having a direction associated therewith, the direction of the uppermost lamina in the mounting pad being substantially aligned with the direction of the lowermost lamina of the base portion of the lowermost arm of the lowermost tier, the mounting pad being connectable to a source of motive energy.

35. The centrifuge rotor of claim 28 wherein the direction of the uppermost lamina of the upper transition pad in each tier and the lowermost lamina of the lower transition pad in each tier respectively align with the directions of the lower lamina of the upper arm in the tier and the upper lamina of the lower arm of the tier.

36. The centrifuge rotor of claim 35 in the direction of the uppermost lamina of the upper connection pad aligns with the direction of the lowermost lamina of the upper tier and the direction of the lowermost lamina of the lower connection pad aligns with the direction of the uppermost lamina of the lower tier.

37. The centrifuge rotor of claim 36 further comprising a mounting pad disposed below the base portion of the lowermost arm of the lowermost tier, the mounting pad being formed from a stacked plurality of laminae each of which is itself formed of fibers in a resin matrix, each lamina in the base portion of the lowermost arm of the lowermost tier and in the mounting pad having a direction associated therewith, the direction of the uppermost lamina in the mounting pad being substantially aligned with the direction of the lowermost lamina of the base portion of the lowermost arm of the lowermost tier, the mounting pad being connectable to a source of motive energy.

38. The centrifuge rotor of claim 28 wherein the direction of the uppermost lamina of the upper connection pad aligns with the direction of the lowermost lamina of the upper tier and the direction of the lowermost lamina of the lower connection pad aligns with the direction of the uppermost lamina of the lower tier.

39. The centrifuge rotor of claim 38 further comprising a mounting pad disposed below the base portion of the lowermost arm of the lowermost tier, the mounting pad being formed from a stacked plurality of laminae each of which is itself formed of fibers in a resin matrix, each lamina in the base portion of the lowermost arm of the lowermost tier and in the mounting pad having a direction associated therewith, the direction of the uppermost lamina in the mounting pad being substantially aligned with the direction of the lowermost lamina of the base portion of the lowermost arm of the lowermost tier, the mounting pad being connectable to a source of motive energy.

40. The centrifuge rotor of claim 28 further comprising a mounting pad disposed below the base portion of the lowermost arm of the lowermost tier, the mounting pad being formed from a stacked plurality of laminae each of which is itself formed of fibers in a resin matrix, each lamina in the base portion of the lowermost arm of the lowermost tier and in the mounting pad having a direction associated therewith, the direction of the uppermost lamina in the mounting pad being substantially aligned with the direction of the lowermost lamina of the base portion of the lowermost arm of the lowermost tier, the mounting pad being connectable to a source of motive energy.

* * * * *